US005791923A

United States Patent [19]

Picaud et al.

[11] Patent Number: 5,791,923

[45] Date of Patent: Aug. 11, 1998

[54] TAB TERMINAL WITH SHORT CIRCUITING SPRING MEMBER

[75] Inventors: Jean-Pierre Picaud, Eaubonne; Thierry Corriou, Ecquevilly; Jean Claude Joly, Osny, all of France

[73] Assignee: The Whitaker Corporation, Wilmington, Del.

[21] Appl. No.: 920,201

[22] Filed: Aug. 15, 1997

Related U.S. Application Data

[63] Continuation of Ser. No. 543,675, Oct. 16, 1995, abandoned.

[30] Foreign Application Priority Data

Oct. 20, 1994 [FR] France ..... 94 12541

[51] Int. Cl.[6] ..... H01R 29/00

[52] U.S. Cl. ..... 439/188; 439/825

[58] Field of Search ..... 439/188, 825, 439/746, 747, 748, 749, 826, 827; 200/51.1

[56] References Cited

U.S. PATENT DOCUMENTS

| | | | |
|---|---|---|---|
| 4,753,605 | 6/1988 | De Young | 439/347 |
| 4,850,888 | 7/1989 | Denlinger et al. | 439/188 |
| 5,209,680 | 5/1993 | Fry | 439/825 |
| 5,273,448 | 12/1993 | Myer et al. | 439/188 |
| 5,346,405 | 9/1994 | Mosser, II et al. | 439/188 |
| 5,516,299 | 5/1996 | Fukuda et al. | 439/188 |

FOREIGN PATENT DOCUMENTS

| | | | |
|---|---|---|---|
| 62-64082 | 3/1987 | Japan | 439/188 |

*Primary Examiner*—Gary F. Paumen
*Assistant Examiner*—Barry M. L. Standig
*Attorney, Agent, or Firm*—Driscoll A. Nina

[57] ABSTRACT

A tab terminal comprises a box-shaped body section having short circuit cantilever beam spring members projecting outwardly from side walls thereof. The terminals are for mounting in a connector assembly matable to a complementary connector assembly for applications such as automotive airbags where a short circuiting function is required between adjacent terminals of a connector assembly. Spring members of adjacent terminals thus abut and electrically contact each other when mounted in a connector assembly that is disconnected. The complementary connector assembly has a wall portion that is insertable between the contacting spring members for separation thereof when the assemblies are mated. Due to the distribution of flexible movement between spring members of both adjacent contacts, and due to the integration of the spring members within the terminals, a more compact connector assembly can be provided, and furthermore stresses are reduced within the short circuiting spring members in comparison to the prior art.

16 Claims, 8 Drawing Sheets

TAB TERMINAL WITH SHORT CIRCUITING SPRING MEMBER

This application is a Continuation of application Ser. No. 08/543,675 filed Oct. 16, 1995, now abandoned.

BACKGROUND OF THE INVENTION

1. Field of the Invention

This invention relates to an electrical terminal mountable in an insulative housing of an electrical connector assembly and electrically connectable to a complementary terminal of a complementary connector assembly, the terminal having spring contacts for electrical interconnection with an adjacent terminal of the connector assembly when unmated, for short circuit electrical connection therebetween.

2. Description of the Prior Art

For safety reasons, there are a number of applications where it is necessary to short circuit electrical terminals of a connector when the connector is uncoupled from its complementary mating connector. A typical application is for connector assemblies of the electrical circuit of automotive airbags, whereby voltage differences, electrostatic or electromagnetic interference, could detonate the airbag when a connector of the airbag electrical circuitry is disconnected, for example during revision or maintenance. In order to avoid voltage differences that could detonate the airbag, terminals electrically interconnected to the detonation circuit of the airbag are short circuited when the circuit is broken.

In the prior art, a common means of short circuiting adjacent terminals is the provision of an additional contact extending between the terminals to be short circuited, the short circuiting member being deflectable during mating of the connector assemblies to break contact between adjacent terminals. The short circuit spring member may be disconnected from the terminal by wall portions of the complementary connector assembly that are inserted between the short circuit member and either of the terminals.

One of the problems of the above design, is that the short circuit contact is an additional part that must be mounted and retained within the connector housing which therefore increases the space requirements and cost thereof. Furthermore, the need to provide compact connectors, often means that the short circuit spring members have reduced resilient movement and are therefore under high stress conditions when the connectors are mated. Under severe thermal and mechanical solicitation (e.g. vibration) such as is common in automotive connectors, a short circuit spring under high stress may fail.

SUMMARY OF THE INVENTION

It is therefore an object of this invention to provide a connector assembly having short circuiting means that is compact and does not substantially increase the space requirements of the connector assembly.

It is a further object of this invention to provide a connector assembly with short circuiting means that is subject to a relatively low level of stress, and therefore that is reliable.

Yet another object of this design is to provide the above mentioned connector assembly in a cost-effective manner.

The objects of this invention have been achieved by providing a terminal having a box-shaped body section comprising a bottom wall, side walls and a top wall, the body section further comprising spring beams attached thereto and projecting from within the box-shaped body section outwardly through cutouts in the side walls, for electrically contacting a similar spring beam of an adjacent terminal when the connector assembly is disconnected from a complementary connector assembly. The complementary connector assembly may comprise an insulative wall portion that is insertable between the side walls of adjacent terminals so as to separate the interconnected spring beams of adjacent terminals, thereby breaking the short circuit therebetween. During separation of the spring beams, the spring beams are biased towards the interior of the terminal body section. In an embodiment, the terminal may comprise a pair of short circuiting spring beams projecting from opposed side walls in a symmetrical manner. Integration of the short circuit members within the adjacent contacts, eliminates the need for a separate means for mounting and securing a separate short circuit member, and furthermore distributes the required flexibility between the adjacent contacts, thus providing a more compact design with greater reliability and lower cost.

DETAILED DESCRIPTION OF THE PREFERRED EMBODIMENT

Figure 1:
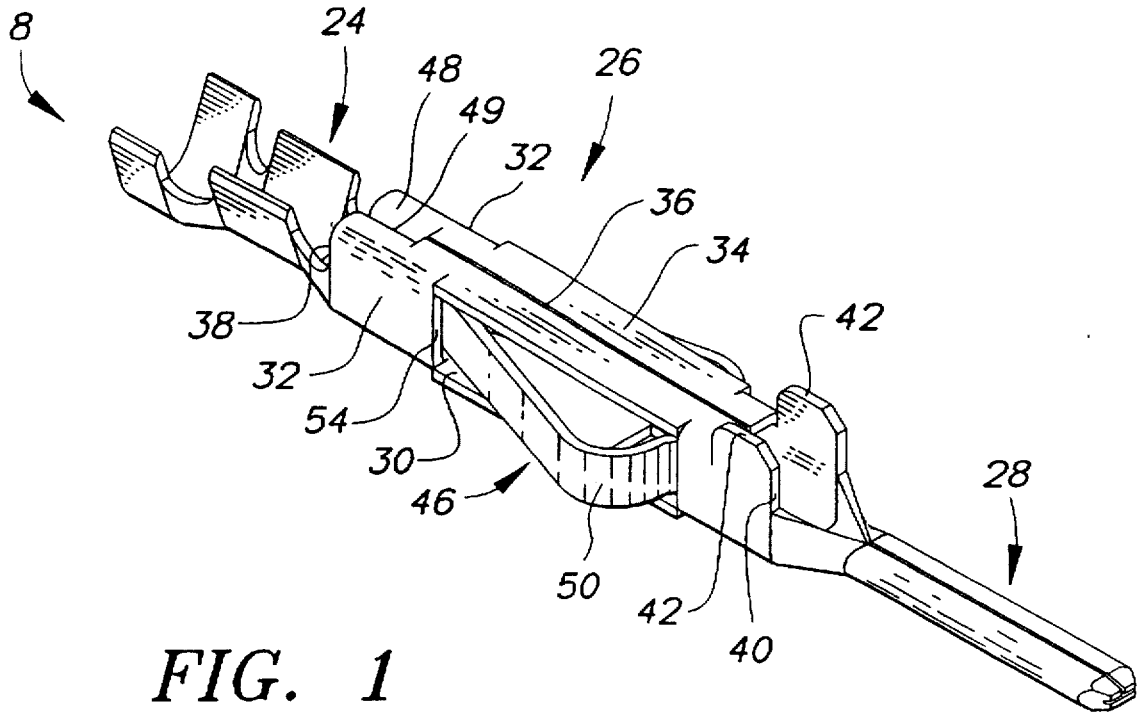
FIG. 1 is an isometric view of a terminal according to this invention.

Referring first to FIGS. 6–11, an electrical connector assembly 2 comprises an insulative housing 4 having cavities 6 extending therethrough for assembly of stamped and formed tab terminals 8 therein. The connector assembly 2 is matable to a complementary connector assembly 10 having an insulative housing 12 with cavities 14 extending therethrough for assembly of receptacle terminals 16 therein, the receptacle terminals 16 electrically connectable to tab portions of the tab terminals 8.

The connector assembly 2 comprises a further cavity 18 positioned between adjacent cavities 6 for receiving a wall portion 20 extending from a mating face 22 of the complementary connector assembly 10. When the connector assemblies 2 and 10 are mated together, the wall portion 20 is thus positioned between adjacent terminals 8 of the connector assembly 2.

Figure 2:
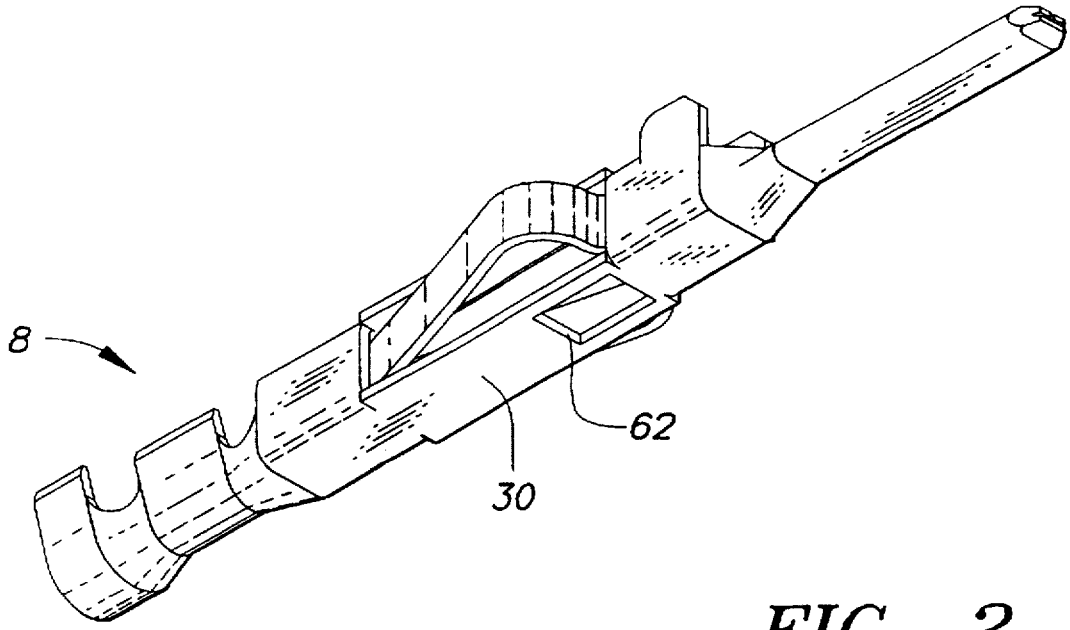
FIG. 2 is another isometric view of the terminal of FIG. 1 from underneath.
Figure 3:
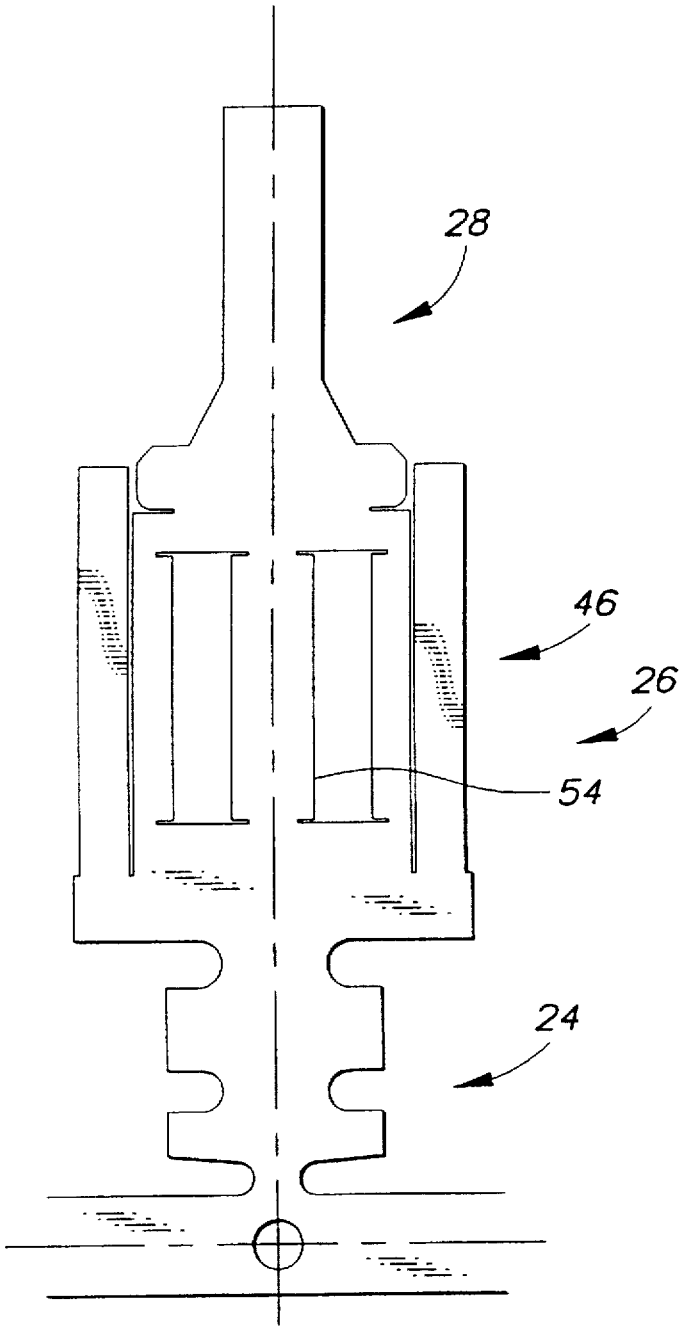
FIG. 3 is a plan view of the terminal of FIGS. 1 and 2 only partially edge-stamped.
Figure 4:
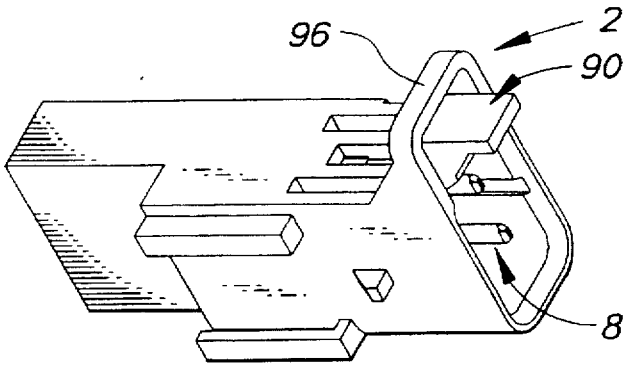
FIGS. 4 and 5 are isometric views of connector assembly housing receiving the terminals of FIGS. 1 and 2.
Figure 5:
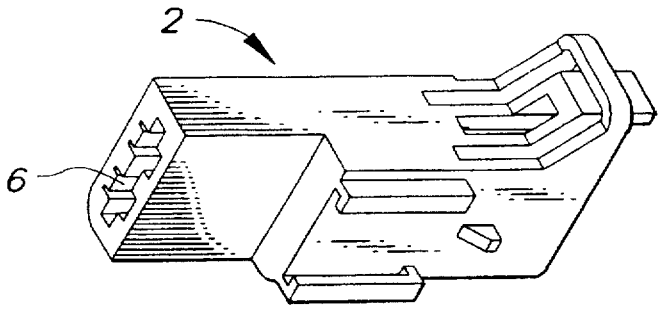
Figure 6:
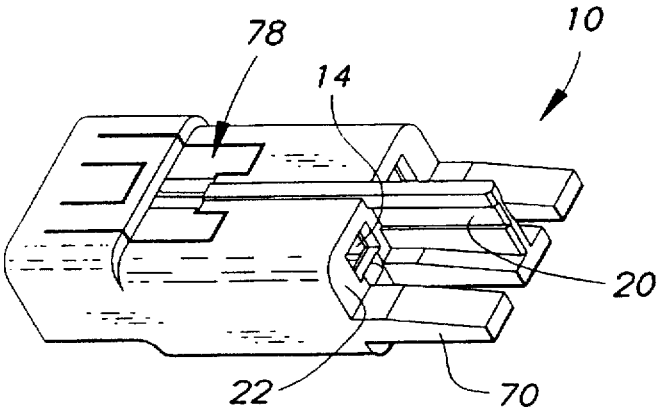
FIG. 6 is an isometric view of a complementary connector matable with the connector of FIGS. 4 and 5.
Figure 7:
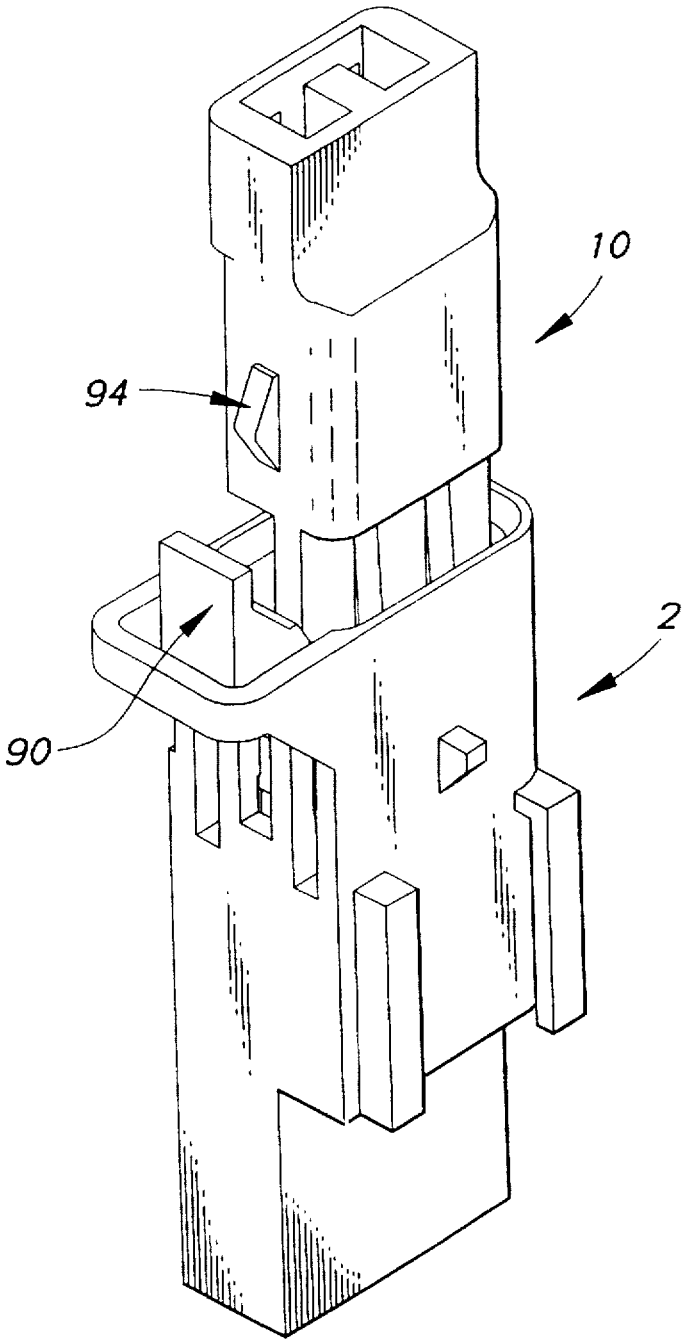
FIG. 7 is an isometric view of the connector assemblies being mated together.

Referring to FIGS. 1 and 2, the tab terminal 8 comprises a conductor connection section 24 for attachment of an electrical conducting wire thereto by means of crimping, a box-shaped body section 26 extending longitudinally therefrom, further extending longitudinally into a tab portion 28 for electrical contact with the receptacle terminal 16 of the complementary connector assembly 10. The box-shaped body section 26 comprises a bottom wall 30, a pair of opposed side walls 32 and a top wall 34 having a longitudinal seam 36 resulting from the folding together of the box-shaped body section which is stamped and formed from sheet metal. The body section 26 extends between a connection end 38 proximate the connection portion 24 to a mating end 40 proximate the tab section 28. At the mating end 40, the body section 26 comprises side wall extensions 42 projecting beyond the top wall 34 and receivable in grooves 44 (see FIG. 8) of the housing cavity 6 to ensure correct polarization of the terminal within the cavity 6 when assembled thereto.

The body section 26 further comprises spring members 46 that are in the shape of cantilever beams attached integrally to the body section proximate the connection end 38 by a folded-over, U-shaped bridging portion 48. A pair of mirror image spring members 46 is disposed about a plane substantially centrally positioned between opposed side walls 32, the pair of spring beams having attachment portions 49 integral with the U-shaped bridging portions 48, the attachment portions 49 contiguous each other. From the attachment portions 49, the spring members 46 diverge away from each other towards the mating end 40 to a culminate in a contact portion 50, and then converge towards each other to free ends 52 (see FIG. 9) positioned within the body section between the side walls 32. The spring members 46, and in particular the contact portions 50 project through cutouts 54 of the side walls 32 therebeyond. The free ends 52 of the spring beam members 46 project beyond forward edges 56 of the cutouts 54, and in the unassembled state of the terminal, are biased against the inner surface 58 (see FIG. 9) of the side walls 32 due to prestressing of the spring members outwardly. The free ends 52 thus act as stops for limiting outward movement of the prestressed spring beams 46. The free ends 52 however also act as anti-overstress features by providing an abutment that abuts the free end 52 of the opposed spring beam thereby limiting insertion of the spring member 46 towards the inside of the body section.

Figure 9:
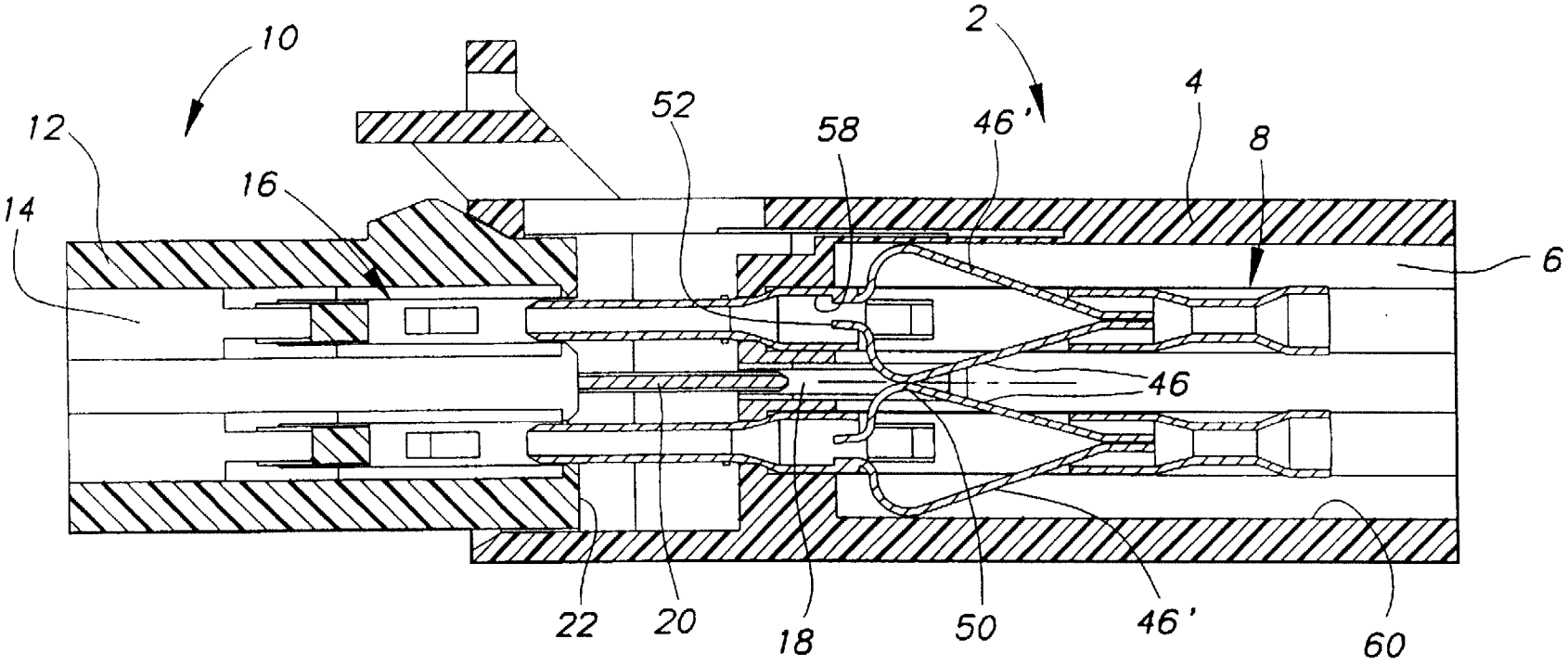

Referring now to FIG. 9, a pair of terminals 8 are shown mounted in adjacent cavities 6 whereby adjacent spring members 46 resiliently abut each other at their contact sections 50 thereby creating a short circuit between the adjacent terminals. In this configuration, the spring members 46 are inwardly biased thereby biasing the free end 52 away from its corresponding side wall 32 towards the inside of the box-shaped body section. Due to the positioning of the spring member 46 within the tab, the provision of a relatively long spring beam, and the use of two spring beams for providing the required flexibility and contact force, the terminals 8 can be positioned relatively close together without extra provision of space for a separate short circuit spring, whilst nevertheless resulting in low stress within the spring members 46 and thus increased durability and reliability. Furthermore, the outer non-contacting spring members 46' can be used to abut resiliently a side wall 60 of the cavity adjacent the terminal side walls 32 in order to provide a spring force in reaction to the spring force of the inner contact arms 46. The latter can thus be used to ensure that the terminals are positioned substantially centrally within the cavity 6 for parallel alignment of the tabs 28 with the mating receptacle terminal 16. Without this, the terminals would be angled with respect to each other due to the outward pushing force of the short circuit spring members thereby increasing the chance of stubbing of the tab terminals 28 against portions of the complementary connector assembly 10.

Figure 8:
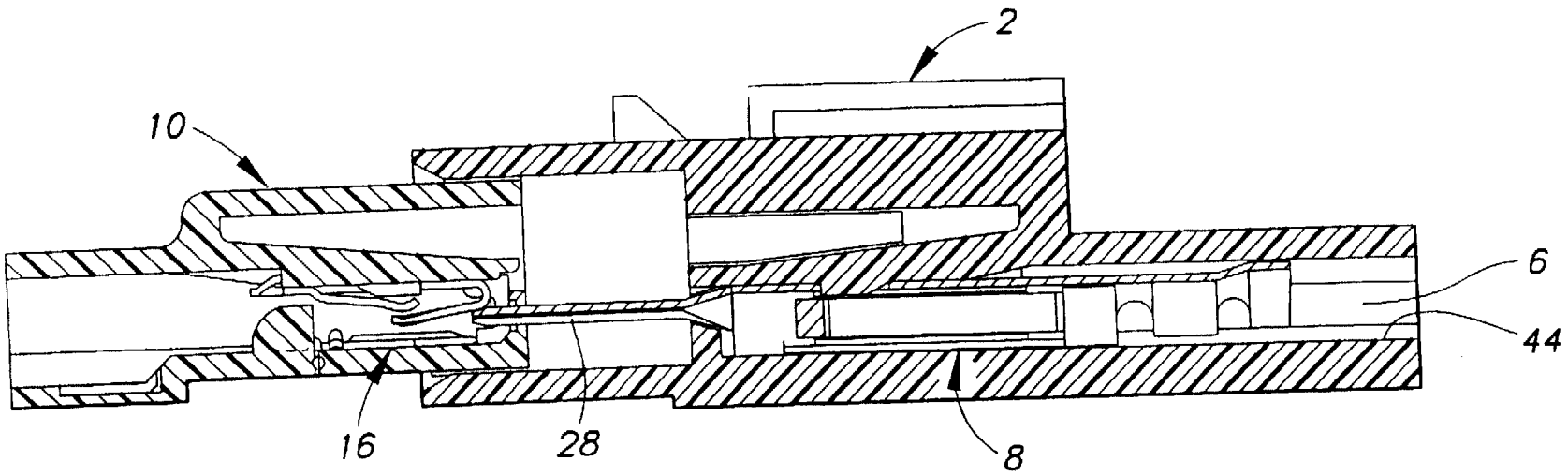
FIGS. 8 and 9 are cross-sectional views through the connector assemblies in an initial stage of their mating sequence.

In FIGS. 8 and 9, the complementary connector assemblies 2, 10 are shown in the initial stage of coupling therebetween, whereby electrical contact between the tab 28 and the receptacle terminal 16 is established whilst the adjacent terminals 8 are still electrically interconnected. The latter is to ensure that any voltage differences between the uncoupled connectors is first eliminated prior to breaking the short circuit.

Figure 10:
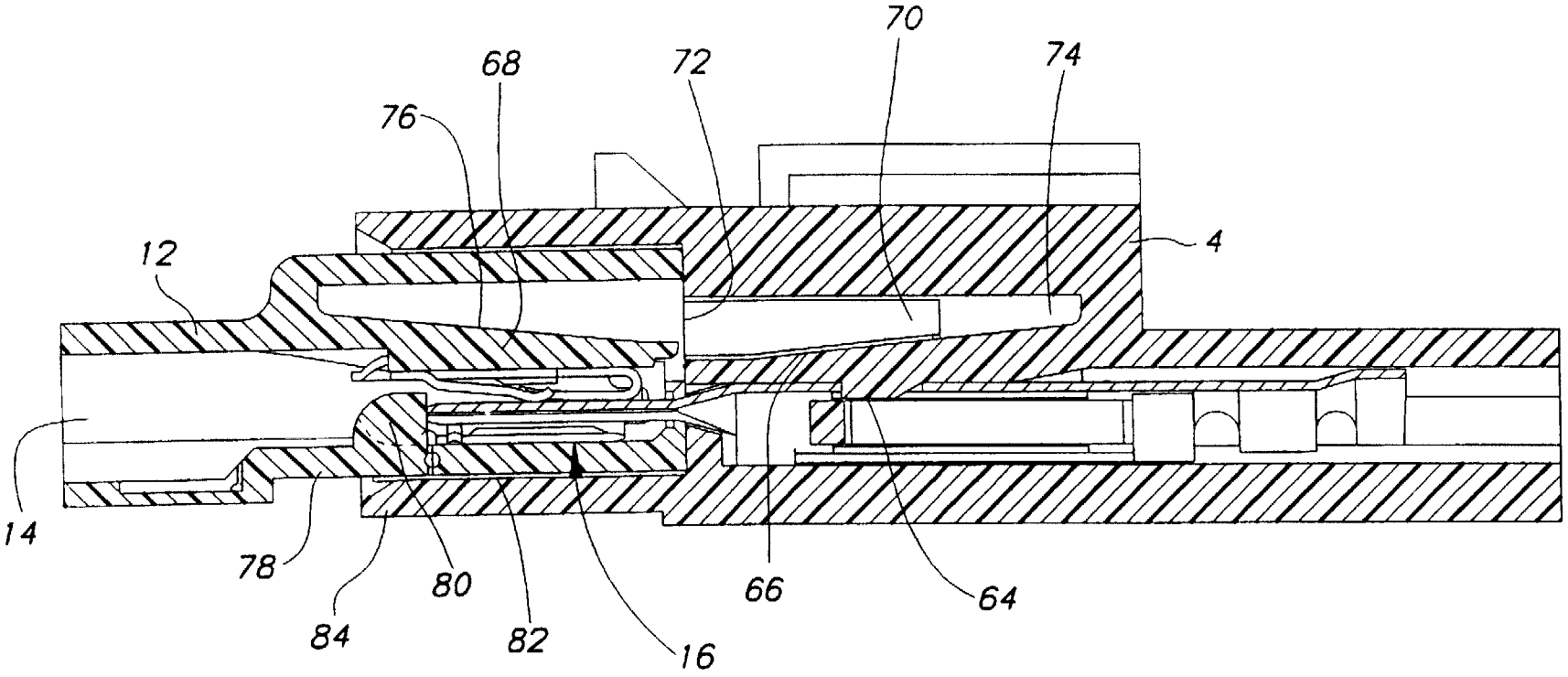
FIGS. 10 and 11 are similar cross-sectional views to FIGS. 8 and 9 respectively, but showing the connector assemblies in the fully mated position.
Figure 11:
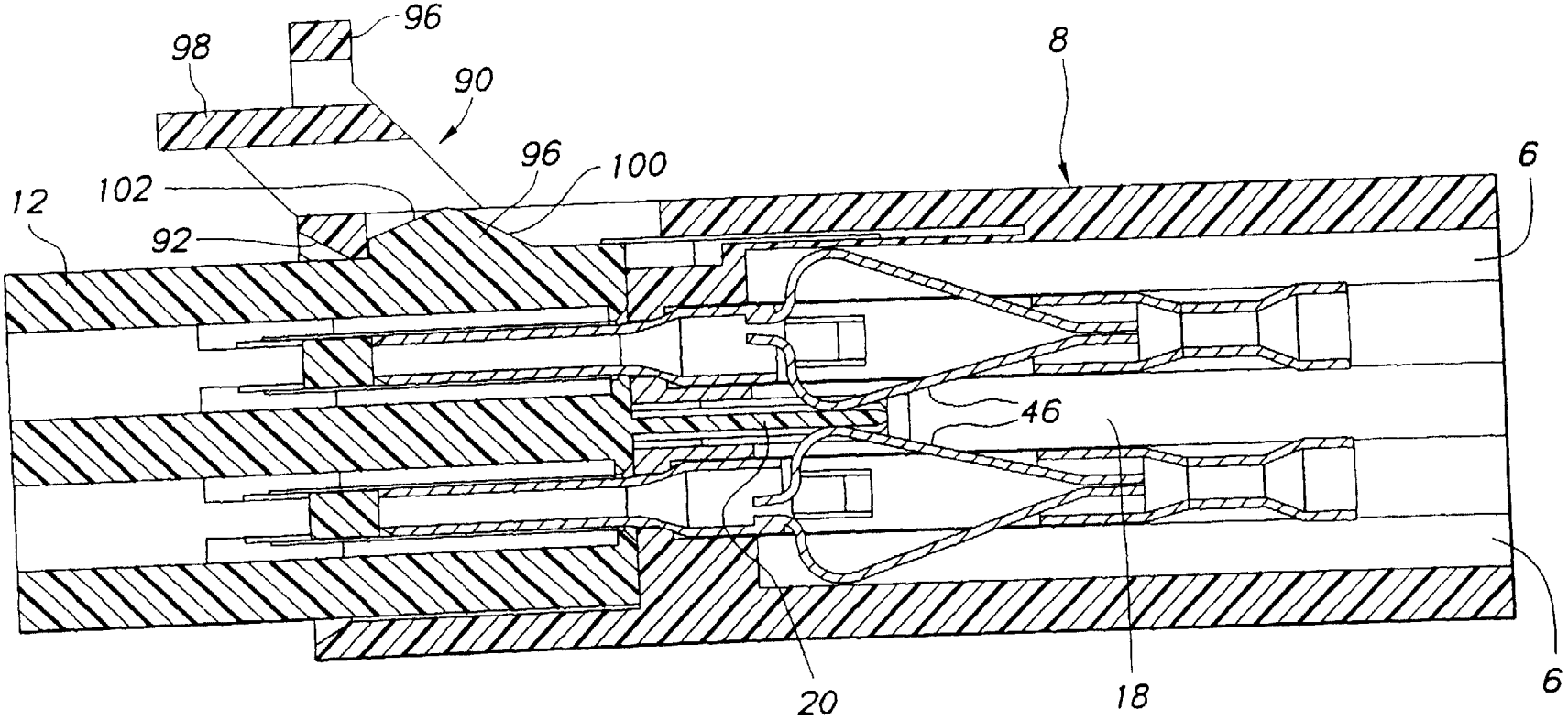

Referring to FIGS. 10 and 11, the complementary connector assemblies 2, 10 are shown in the fully mated position whereby the wall portion 20 is inserted between the spring members 46 of adjacent terminals 8 for breaking of the short circuit. The thickness of the wall portion 20 causes inward biasing of the spring member 46, but is evenly distributed therebetween thereby reducing the required flexibility of the short circuit spring members, in comparison to the prior art.

As can be seen in FIG. 10 and FIG. 2, the terminal 8 comprises a cutout 62 in the bottom wall 30 for receiving a latching protrusion 64 of an integrally moulded locking lance 66 of the housing 4. Similarly, the receptacle terminals 16 of the complementary connector assembly 10 are retained therein by integrally moulded resilient locking lances 68 of the housing 12. The complementary housing 12 has projections 70 extending beyond a mating face 72 that are engageable against and alongside an outer surface 74 of the locking lances 66 when the connector assemblies are mated together for ensuring that the locking lance is securely held in position thereby preventing extraction of the terminals 8 from the cavities 6. Similarly, the housing 4 of the connector 2 could be provided with projections that are inserted against the outer face 76 of the locking lances 68 of the complementary connector for ensuring locking of the receptacle terminal 16 within their cavities 14. The embodiment shown in FIG. 10 provides secondary locking for the receptacle terminal 16 by means of a housing flap 78 having an inwardly directed projection 80 that is foldable into and against the rearward shoulder of the terminal 16 for secondary locking thereof within the cavity 14. The connectors 2,10 can only be mated together if the flap 80 is in the fully closed position flush with an outer surface 82 of the connector housing 12, as the flap would otherwise abut a shroud 84 of the connector housing 4 which receives the complementary connector.

Referring to FIG. 11, the connector housing 4 is shown comprising an integral resilient latching member 90 that comprises a transverse latching bar 92 biasable over and retainable behind a latching protrusion 94 integral with the complementary housing 12. An anti-overstress bar 96 is provided above a release member 98 of the latch 90 for preventing overstressing of the latch 90 when outwardly biasing the release member 98 when unlatching the mated connectors. The latching protrusion 94 has a slanted surface 100 obliquely directed towards the connector 2, and a slanted surface 102 obliquely directed away from the connector 2, whereby the first slanted surface 100 ensures that if the connector assemblies 2,10 are only partially mated, the resilient depression of the latching bar 92 thereagainst will tend to separate the connectors thus enabling easier detection of the unmated condition. If however the connector assemblies 2,10 are almost but not completely mated together, the latching bar 92 will be resiliently biased against the second slanted surface 102 thereby tending to pull the connectors together into the fully mated condition. The latter thus ensures correct mating of the connector assemblies 2,10.

Advantageously therefore, the connector assembly with short circuit spring members projecting from the terminal bodies enables a compact and reliable design with low stress of the short circuit spring members.

We claim:

1. An electrical terminal for mounting in a connector assembly housing, the terminal comprising a connection section for electrical connection to a conductor, a body section and a tab contact section integral therewith, for electrical connection to a complementary terminal of a complementary connector assembly, characterized in that the body section comprises a spring member integrally formed therewith and outwardly biased for electrically contacting an adjacent terminal which is mounted in the same connector assembly housing whilst the connector assembly is disconnected from the complementary connector assembly, and wherein the spring member is provided as a cantilever spring beam attached at an attachment portion to the body section, and extending therefrom to a free end, the attachment portion proximate the connection section and arranged within the body section, and the free end proximate the tab contact section and protecting through a sidewall of the body section.

2. The terminal of claim 1 characterized in that the body section is box-shaped and comprises a bottom wall, side walls and a top wall.

3. The terminal of claim 1 characterized in that the spring member extends from the attachment portion obliquely away from the body section to culminate in a contact portion that is biasable against the adjacent terminal, and then extends obliquely inwards towards the body section to the free end disposed therein.

4. The terminal of claim 3 characterized in that the free end comprises a stop portion biasable against the adjacent side wall for limiting outward deflection of the spring member, and furthermore biasable against an opposite side of the body section for limiting inward deflection thereof, thereby preventing overstressing of the spring member.

5. The terminal of claim 3 characterized in that the attachment portion is folded into the box-shape of the body section via a U-shaped bridging portion extending from one of the side walls.

6. The terminal of claim 1 characterized in that a second opposing spring member is provided in mirror image symmetry to the spring member.

7. The connector of claim 6 characterized in that the attachment portions of the pair of spring members are contiguous.

8. The terminal of claim 7 characterized in that the body section is symmetrical about a plane extending longitudinally through the centre of the body section.

9. The terminal of claims 1 characterized in that the spring member is integral with the body section.

10. An electrical terminal for mounting in a connector assembly housing, the terminal comprising a connection section for electrical connection to a conductor, a body section, and a tab contact section for electrical connection to a complementary terminal of a complementary connector assembly, wherein the body section comprises a spring member attached thereto and outwardly biased for electrically contacting an adjacent terminal mounted in said connector assembly housing, and wherein the spring member is provided as a cantilever spring beam attached to the body section at an attachment portion and extending therefrom to a free end, the free end comprising a stop portion biasable against a side wall of the body section for limiting outward deflection of the spring member.

11. The terminal of claim 10 wherein the attachment portion is proximate the connection section, and the free end is proximate the tab contact section.

12. The terminal of claim 10 wherein the body section is box-shaped and comprises a bottom wall, side walls and a top wall.

13. The terminal of claim 10 wherein the spring member is integral with the body section.

14. A connector assembly comprising a plurality of the electrical terminals according to claim 10, comprising a housing having terminal receiving cavities extending therethrough for securely receiving the terminals therein, and an intermediate cavity positioned intermediate adjacent said terminal receiving cavities for receiving a wall portion of a complementary connector assembly therein for the purpose of separating a short circuit connection between adjacent terminals.

15. The connector assembly of claim 14 wherein on a side of the terminal receiving cavity opposite to the intermediate cavity, a wall of the housing is provided at a certain distance from the terminal body section so as to act as an abutment surface for an opposing spring member of the terminal such that the opposing spring member is resiliently biased in opposition to the spring member, for the purpose of correctly positioning the terminal within the cavity, in alignment with the complementary terminal of the complementary connector.

16. A combination of the connector assembly of claim 15, and the complementary connector assembly matable therewith, wherein the complementary connector assembly comprises a wall portion extending from a mating face thereof towards the connector assembly and insertable into the intermediate cavity thereof for breaking a short circuit connection.

* * * * *